US006997827B1

(12) United States Patent
Grace, Jr. et al.

(10) Patent No.: US 6,997,827 B1
(45) Date of Patent: Feb. 14, 2006

(54) AERODYNAMIC IMPROVEMENTS TO ARCHERY BROADHEADS

(75) Inventors: Louis Grace, Jr., North Street, MI (US); Nathaniel E. Grace, Port Huron, MI (US)

(73) Assignee: G5 Outdoors, L.L.C., Memphis, MI (US)

( * ) Notice: Subject to any disclaimer, the term of this patent is extended or adjusted under 35 U.S.C. 154(b) by 0 days.

(21) Appl. No.: 10/756,104

(22) Filed: Jan. 13, 2004

Related U.S. Application Data

(60) Provisional application No. 60/440,289, filed on Jan. 15, 2003.

(51) Int. Cl.
*F42B 6/08* (2006.01)

(52) U.S. Cl. ..... 473/583

(58) Field of Classification Search ..... 473/583, 473/584

See application file for complete search history.

(56) References Cited

U.S. PATENT DOCUMENTS 4,036,499 A * 7/1977 Sherwin ..... 473/584
4,169,597 A 10/1979 Maleski
4,392,654 A 7/1983 Carella
4,505,482 A * 3/1985 Martin, Sr. ..... 473/583
5,137,282 A * 8/1992 Segar et al. ..... 473/583
5,145,186 A * 9/1992 Maleski ..... 473/584
5,192,081 A * 3/1993 Cooper ..... 473/584
5,871,410 A 2/1999 Simo et al.
6,045,468 A * 4/2000 Tinsley et al. ..... 473/584
6,077,180 A * 6/2000 Adams, Jr. ..... 473/584
6,663,518 B1 12/2003 Kuhn

* cited by examiner

*Primary Examiner*—John A. Ricci
(74) *Attorney, Agent, or Firm*—Harness, Dickey & Pierce, P.L.C.

(57) ABSTRACT

The present is directed to a specific broadhead configuration for reducing the turbulence generated by a broadhead in flight, thereby reducing the resulting wind noise and aerodynamic drag generated in flight. The aerodynamic improvements to the archery broadhead are accomplished by providing edge treatments on at least one of the leading edges, trailing edges oblique edges or longitudinal edges of the broadhead blades. Specific edge treatments may include a linear tapered profile, a non-linear tapered profile or a radiused or rounded profile. Furthermore, certain edge treatments may be asymmetric so as to impart a rotational moment or spin to the arrow during flight. Such edge treatments are suitable for use on vented and non-vented blades.

35 Claims, 5 Drawing Sheets

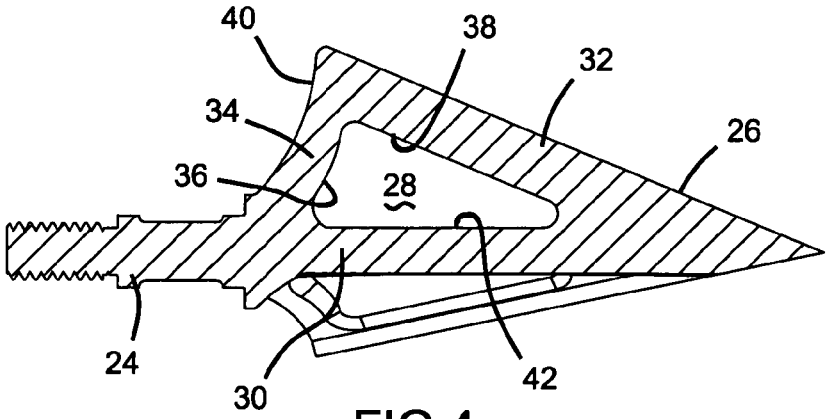
FIG 4
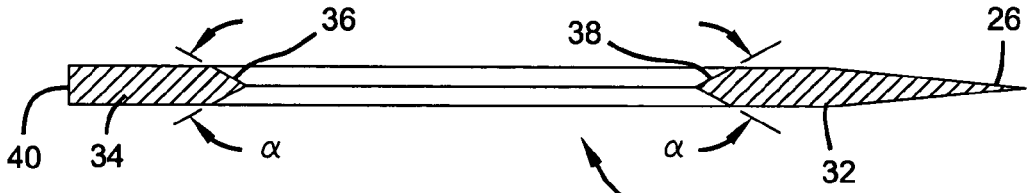
FIG 5
FIG 6
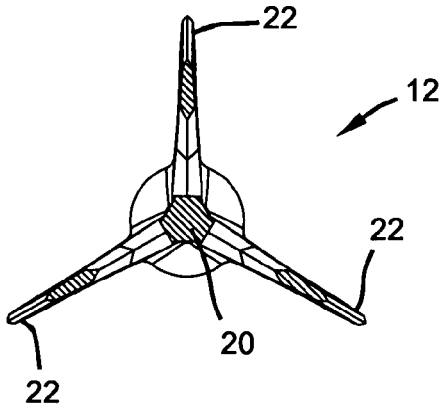

AERODYNAMIC IMPROVEMENTS TO ARCHERY BROADHEADS

CROSS-REFERENCE TO RELATED APPLICATIONS

This application claims the benefit of U.S. Provisional Application No. 60/440,289, filed on Jan. 15, 2003. The disclosure of the above application is incorporated herein by reference.

FIELD OF THE INVENTION

The present invention relates to archery broadheads and more particularly to the geometric configuration of the broadhead blade that enhances the aerodynamics of the broadhead to reduce the turbulence and noise generated thereby in flight.

BACKGROUND OF THE INVENTION

Recent developments in the fabrication of archery broadheads by powder injection molding processes have increased the flexibility in broadhead design and enabled better control on the dimensions, weight and variability of the end product. As an example, blade configurations of the broadhead may be thicker and/or may include variable thickness within the cross-section—e.g., taper from the ferrule to the sharpened edge. The use of thicker blade configurations satisfies the desire for stronger archery broadheads. However, it has been determined that thicker blades may also have the adverse effect of increasing the air turbulence and hence the noise of the arrow in flight.

When an arrow is shot from a bow at 180 to 350 feet per second, the broadhead, being the leading component, will encounter resistance from the air. With thicker blade designs, the increased frontal area (i.e., the area of the broadhead normal to the apparent wind) tends to exacerbate the turbulence and noise generation which is best described as a swishing or whistling noise. A quiet broadhead is important to a successful hunt because the hunted prey may "duck" or otherwise avoid an arrow if it can hear its approach. The adverse effect of a noisy arrow increases as the shooting distances increase. Therefore, there is a need to improve the aerodynamics of the broadhead to create a quieter arrow during flight.

SUMMARY OF THE INVENTION

The present invention is directed to a broadhead having a reduced aerodynamic drag, thereby decreasing the air turbulence and wind noise generated during flight. The present invention is accomplished by shaping the broadhead, and in particular the blade, such that the leading surfaces are smoothly shaped to the apparent wind. The trailing surfaces may also be shaped to minimize the effects of airflow separation from the broadhead that tend to increase the drag generated thereby. The geometric configurations may also be shaped to impart rotation of the arrow during flight to enhance the flight dynamics thereof.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 4 is a cross-sectional view taken along line IV—IV shown in FIG. 2;

FIG. 5 is a cross-sectional view taken along line V—V shown in FIG. 3;

FIG. 6 is a cross-sectional view taken along line VI—VI shown in FIG. 3;

DETAILED DESCRIPTION OF THE PREFERRED EMBODIMENTS

The following description of the preferred embodiments is merely exemplary in nature and is in no way intended to limit the invention, its application, or uses.

Figure 1:
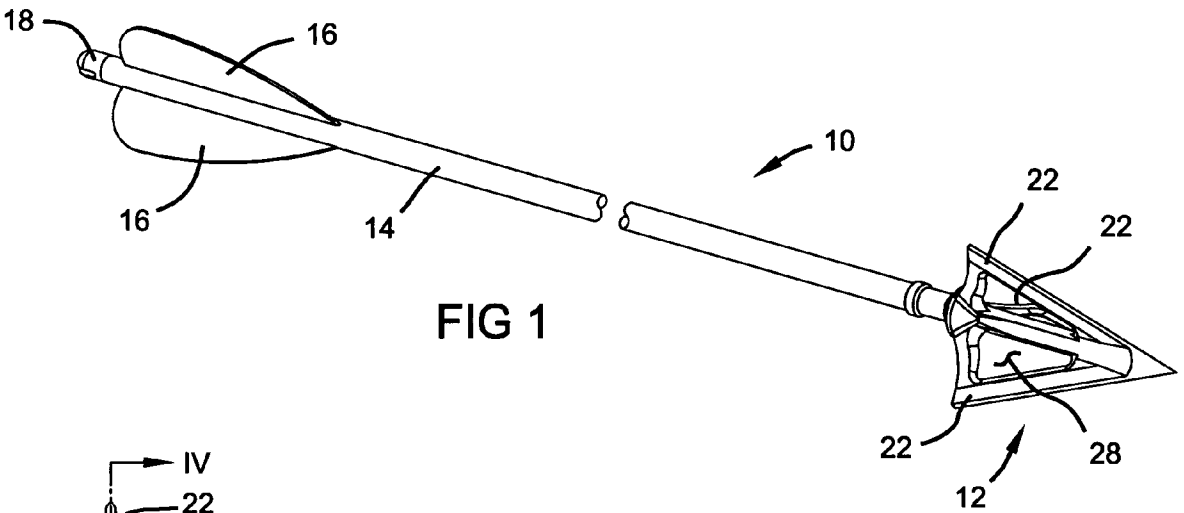
FIG. 1 is an isometric view of an arrow including a vented broadhead in accordance with a first preferred embodiment of the present invention.
Figure 2:
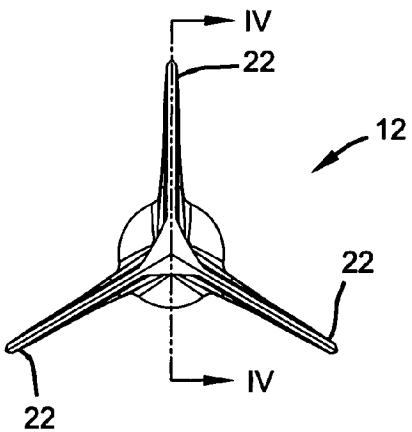
FIG. 2 is a front view of the broadhead illustrated in FIG. 1.
Figure 3:
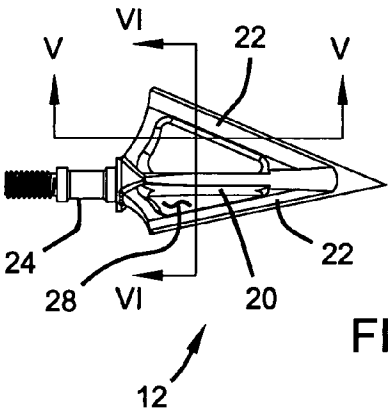
FIG. 3 is a side plan view of the broadhead illustrated in FIG. 1.

With reference now to the drawings and in particular to FIGS. 1–3, the present invention is directed to an archery arrow 10 having a fixed blade broadhead 12, an arrow shaft 14, fletching feathers 16 secured to the arrow shaft 14 and a nock 18. The broadhead 12 includes ferrule 20, cutting blades 22 extending radially outwardly from ferrule 20 and shank 24 extending axially rearwardly from ferrule 20. As used herein the term blade refers to the portion of the broadhead that extends outwardly from a centerline or central longitudinal axis of the broadhead. Shank 24 has a threaded portion adapted to be received within arrow shaft 14 for releasably securing the broadhead 12 to the arrow shaft 14.

As illustrated in the FIGS. 1–6, a vented broadhead 12 includes three blades 22 equiangularly disposed about ferrule 20. Cutting blades 22 have a cutting edge 26 formed along the lateral leg 32 thereof. A generally triangular aperture or vent 28 is formed in the body of each cutting blade 22 to reduce the overall weight of the broadhead and distribute the mass of the blade around its perimeter. Thus, each blade 22 includes a medial leg 30, a lateral leg 32 having the distal cutting edge 26 formed thereon and radial leg 34 extending between the medial leg 30 and lateral leg 32. The broadheads illustrated in the figures represent a monolithic fixed blade design in which the medial leg 30 is defined by a portion of the ferrule 20. However, one skilled in the art will readily recognize that the present invention may be adapted for use with a broadhead having multiple components such as a broadhead having blades releasably secured to a ferrule. In this configuration, each blade would itself include a medial leg. As presently preferred, blade 22 has a tapering cross section from the medial leg 30 adjacent the ferrule 20 to the distal cutting edge 26 as best seen in FIGS. 2 and 6.

Figure 8:
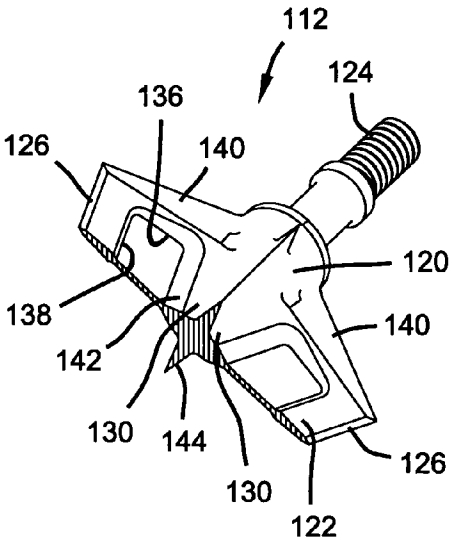
FIG. 8 is an isometric cross-sectional view taken along line VIII—VIII shown in FIG. 7.
Figure 7:
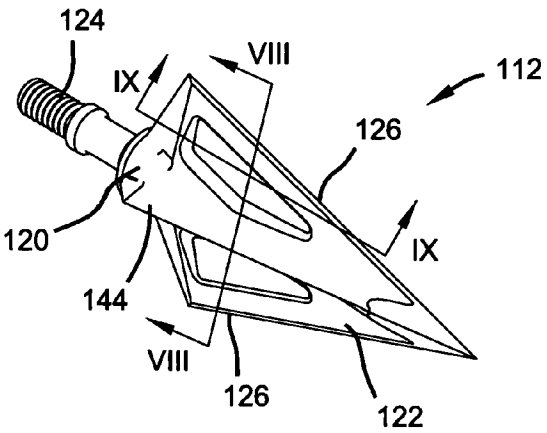
FIG. 7 is an isometric view of a non-vented broadhead in accordance with a second preferred embodiment of the present invention.
Figure 9:
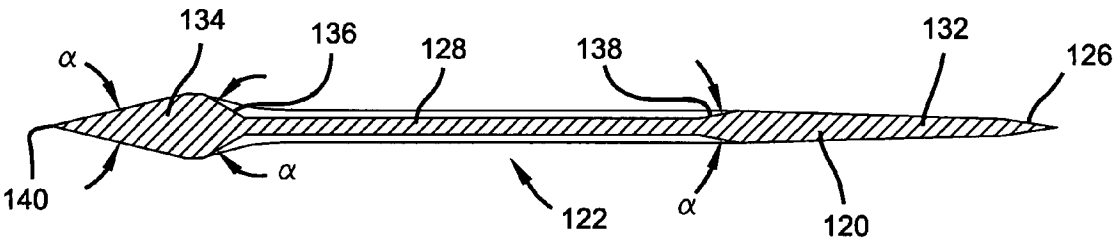
FIG. 9 is a cross-sectional view taken along line IX-1×shown in FIG. 7.

As illustrated in FIGS. 7–9, a non-vented broadhead 112 includes a pair of cutting blades 122 extending outwardly from ferrule 120. Each blade 122 includes a medial legs 130 adjacent the ferrule 120, a lateral leg 132 having the distal cutting edge 126 formed thereon and a radial leg 134 extending between the medial leg 130 and the lateral leg 132. As compared with the vented broadhead 12 illustrated in FIGS. 1–6, the interior of blade 122 is not vented but includes a web structure between the medial leg 130, the lateral leg 132 and the radial leg 134. As illustrated in FIGS. 7–9, blade 122 is provided with a recessed area defining a generally triangular web 128. This recessed area provides means to distribute the mass of the blade around its perimeter while increasing the stiffness of the blade 122 as a whole. The intersection of the web 128 with the lateral leg 132 defines an oblique edge 138. The intersection of the web 128 with the radial leg 134 defines a leading edge 136. The intersection of web 128 with the medial leg 130 defines a longitudinal edge 142. As presently preferred, blade 122 has a tapering cross-section from the medial leg 130 adjacent the ferrule 120 to the distal cutting edge 126 as best seen in FIG. 8. The web 128 is formed within the area circumscribed by legs 130, 132, 134. Alternately, the thickness of the web structure may be generally equal to the legs 130, 132, 134 to provide a planar blade configuration in which an edge treatment in accordance with the present invention is formed on a trailing edge of the radial leg 134.

Broadhead 112 further includes a pair of secondary cutting blades 144 extending generally perpendicular to the cutting blades 122. As best seen in FIGS. 7 and 8, the secondary cutting blade 144 tapers from the forward point of the broadhead rearward towards the shank 124. As best seen in FIG. 8, the size of secondary blade 144 is significantly smaller than the size of the cutting blade 122.

In conventional broadheads, the leading surfaces such as the interior edges formed at the window 28 or web 128 have blunt faces which induce turbulence and thus wind-generated noise during the flight of the arrow. To minimize this effect, a broadhead in accordance with the present invention includes formed edges that are smoothly shaped to the apparent wind. Specifically, the broadhead 12, 112 may include contoured interior edges such as leading edge 36, 136 of the radial leg 34, 134 and oblique edge 38, 138 of lateral leg 32, 132 and the longitudinal edge 42, 142 of the medial leg 30, 130. Likewise, the broadhead 12, 112 may include a contoured trailing edge 40, 140 of the radial leg 34, 134. As shown in FIGS. 5 and 9, the leading edge 36, 136 of the radial leg 34, 134 is forwardly tapered and the oblique edge 38, 138 of the lateral leg 32, 132 is rewardly tapered to minimize the air disturbance of the broadhead in flight. The leading edge 36, 136 and the oblique edge 38, 138 are provided with a linear taper. Such a treatment of the leading edge 36, 136 and oblique edge 38, 138 smoothes the air flow of the broadhead in flight, thereby minimizing the wind noise generated thereby. Likewise, a treatment of the trailing edge 140 of radial leg 134 minimize separation from the broadhead 122, thereby reducing wind drag and noise. The range of the included angle ($\alpha$) of the linear taper is between 20° and 120°, more preferably between 20° and 90°, and most preferably between 30° and 60°.

Figure 10A:
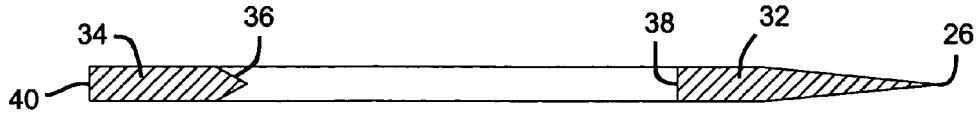
FIGS. 10A–10H are cross-sectional views similar to that shown in FIG. 5 illustrating alternate embodiments of present invention.
Figure 10B:
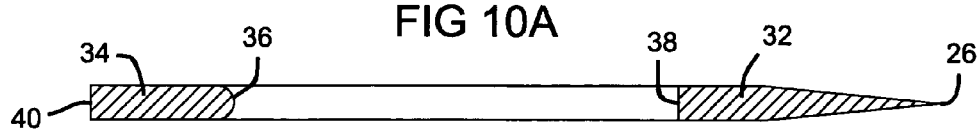
Figure 10C:
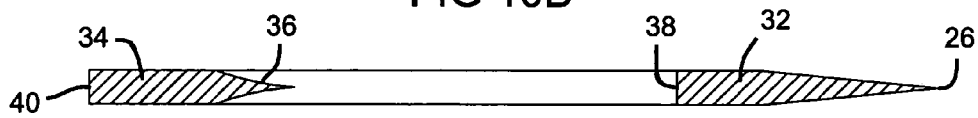
Figure 10D:
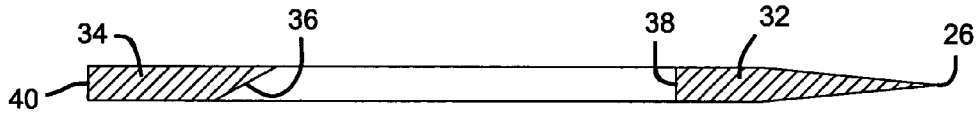

While FIGS. 5 and 9 illustrates generally linear edge treatments, the present invention contemplates a variety of edge treatments which may function to minimize turbulence generated by the broadhead in flight. Specifically, as illustrated in FIGS. 10A–10D, the treatment of leading edge 36 may vary. For example, as illustrated in FIG. 10A, the leading edge 36 is provided with a linear taper similar to that shown in FIGS. 5 and 9. As illustrated in FIG. 10B, the leading edge 36 is provided with a radiused edge treatment. As illustrated in FIG. 10C, the leading edge 36 is provided with a non-linear tapered treatment. As illustrated in FIG. 10D, the leading edge 36 is provided with an asymmetric linear taper. An asymmetric edge treatment such as that illustrated in FIG. 10D may be utilized to induce a rotational moment of the arrow during flight. In this manner, such an edge treatment can be utilized alone or in combination with a helical fletching to enhance the accuracy and flight dynamics of the arrow assembly during flight. The oblique edges 38 and the trailing edges 40 illustrated in FIGS. 10A–10D are not provided with an edged treatment. While the various edge treatments discussed above are shown for a vented broadhead, one skilled in the art will recognize that such edge treatments are equally suitable for use on a non-vented broadhead.

Figure 10E:
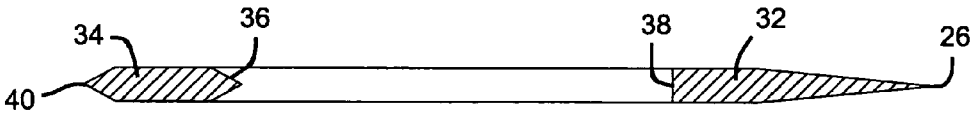
Figure 10F:
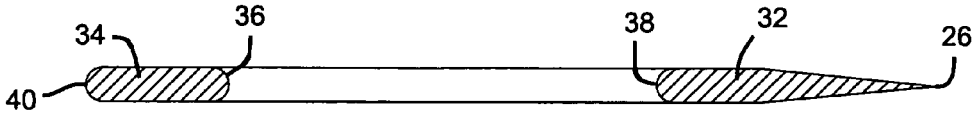
Figure 10G:
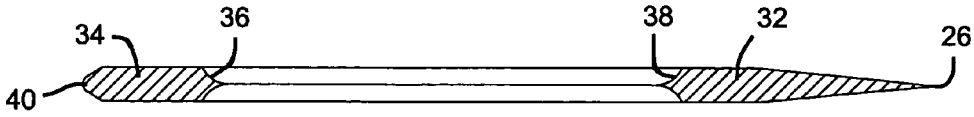
Figure 10H:
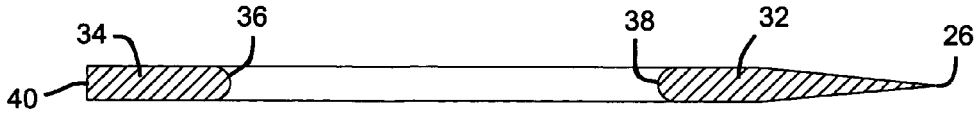

As noted above, the present invention further contemplates other edge treatments on the broadhead to minimize the effects of air flow separation over the broadhead during flight which tends to increase the drag generated thereby. For example, as illustrated in FIGS. 10E–10G, various edge treatments may be utilized on the trailing edge 40 of radial leg 34. Specifically, as illustrated in FIG. 10E, the trailing edge 40 includes a linear taper similar to that formed on the leading edge 36. As illustrated In FIG. 10F, the trailing edge 40 includes a rounded or radiused edge treatment similar to that as shown on leading edge portion 36. As illustrated in FIG. 10G, the trailing edge 40 includes a "boat-tail" treatment having a linear taper portion transitioning to a rounded or curved portion. The present invention further contemplates an edge treatment formed on the oblique edge 38, that is to say the inner edge of the lateral leg portion 32. As illustrated in FIGS. 10F–10H, the treatment of the oblique edge 38 may take various configurations including a rounded or radiused configuration as illustrated in FIGS. 10F and 10H, a non-linear tapered configuration as illustrated in FIG. 10G, or a linear tapered configuration as illustrated in FIG. 5. While the various edge treatments discussed above are shown for a vented broadhead, one skilled in the art will recognize that such edge treatments are equally suitable for use on a non-vented broadhead.

A powder injection molding (PIM) process is particularly well suited for fabrication of the present invention. Specifically, the PIM manufacturing process affords great flexibility and adaptation for fabricating complex shapes. A more detailed description of the PIM manufacturing process as applied to archery broadheads is set forth in U.S. Pat. No. 6,290,903 issued Sep. 18, 2001 entitled "Archery Broadhead and Method of Manufacture" and U.S. Pat. No. 6,595,881 issued Jul. 22, 2003 entitled "Expanding Blade Broadhead", the disclosures of which are expressly incorporated by reference herein. However, the present invention is not limited to PIM-fabricated broadheads but includes broadheads fabricated using any of a variety of known technologies which permit the shaping or machining of the various edges to provide an edge treatment such as, but not limited to, machining, investment casting or fine blanking. Thus, broadheads fabricated by any of the above technologies are considered to be within the scope of the present invention.

The present invention further contemplates a simple test stand for qualitatively evaluating the effectiveness of specific edge treatments of the broadhead blade for imparting rotation to the arrow during flight such as illustrated in FIG.

Figure 11:
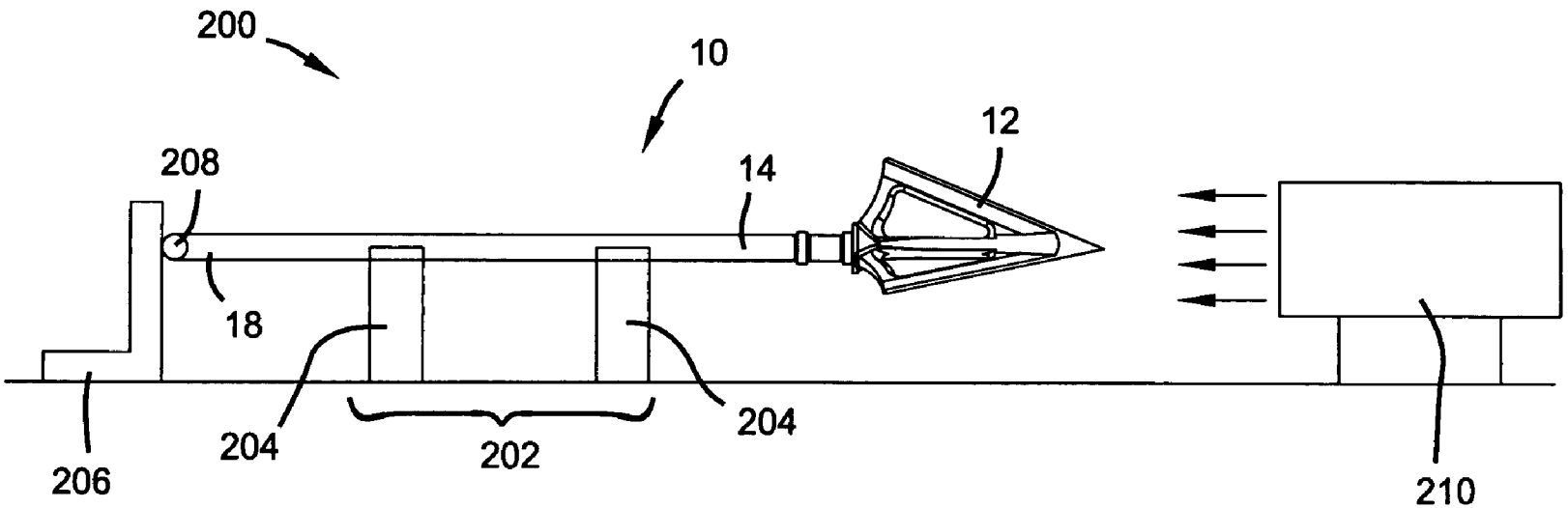
FIG. 11 is a schematic illustration of a testing configuration of the present invention.

10D. In this regard, the test standard is not intended to provide precise quantification of the broadhead aerodynamics. With reference now to FIG. 11, the test stand configuration 200 includes an arrow support cradle 202 having a pair of V-blocks or roller blocks 204 spaced apart to support an arrow shaft 14, while allowing the free rotation thereof. A stop 206 is disposed at the nock end 18 of the arrow 10 to prohibit axial sliding of the arrow shaft relative to the support cradle. A ball bearing 20B is interposed between the stop block 206 and the arrow 10 to further facilitate free rotation of the arrow in the test fixture. An air flow generator 210 such as a source of compressed air or a fan is located forward of the arrow to generate an apparent wind or air flow generally indicated at 212 over the broadhead 12. Specifically, the compressed air source 212 is configured to provide an apparent wind speed between approximately 180 and 350 feet per second. In this configuration, the test stand 200 illustrated in FIG. 11 has proved suitable evaluating an edge treatment on the broadhead blade 22 such as that illustrated in FIG. 10D for inducing a rotational moment on the arrow.

The description of the invention is merely exemplary in nature and, thus, variations that do not depart from the gist of the invention are intended to be within the scope of the invention. For example, the broadheads described and illustrated herein as preferred embodiments are shown to have specific blade configurations; however the present invention may be readily adapted for use on broadheads having other blade configurations. These and other such variations are not to be regarded as a departure from the spirit and scope of the invention.

What is claimed is:

1. A broadhead comprising:

a plurality of blades extending radially from a central longitudinal axis to a cutting edge, each of said plurality of blades tapering so as to narrow in cross-section from said central longitudinal axis to said cutting edge and having a medial leg portion, a lateral leg portion and a radial leg portion; and a contoured edge treatment in cross-section provided on an edge of at least one of said radial leg portion, said lateral leg portion and said medial leg portion.

2. The broadhead of claim 1 wherein each of said plurality of blades having an aperture formed in an interior portion thereof.

3. The broadhead of claim 1 wherein each of said plurality of blades having a recess formed in an interior portion thereof.

4. The broadhead of claim 1 wherein said contoured edge comprises a linear tapered edge.

5. The broadhead of claim 1 wherein said contoured edge comprises a non-linear tapered edge.

6. The broadhead of claim 1 wherein said contoured edge comprises a rounded edge.

7. The broadhead of claim 1 wherein at least one of said plurality of blades further comprises an asymmetric treatment for inducing a rotational moment of said broadhead during flight.

8. A broadhead comprising:

a ferrule having a tip, a central portion and a shank portion;

a plurality of blades equiangularly disposed about said ferrule and extending radially from said central portion, each of said plurality of blades having a lateral portion, a medial portion and a radial portion with a trailing edge, said trailing edge of each of said plurality of blades having a contoured edge treatment in cross-section.

9. The fixed-blade broadhead of claim 8 wherein each of said plurality of blades have an aperture formed in an interior portion thereof such that said lateral portion is provided with an oblique edge, said radial portion is provided with a leading edge and said medial leg is provided with a longitudinal edge, at least one of said oblique edge, said leading edge and said longitudinal edge having a second contoured edge treatment.

10. The fixed-blade broadhead of claim 9 wherein said oblique edge has a second contoured edge treatment and said leading edge has a third contoured edge treatment.

11. The fixed-blade broadhead of claim 9 wherein said leading edge of each of said plurality of blades is contoured to induce a rotational moment on said broadhead during flight.

12. The fixed-blade broadhead of claim 8 wherein each of said plurality of blades have a recess formed in an interior portion thereof such that said lateral portion is provided with an oblique edge, said radial portion is provided with a leading edge and said medial portion is provided with a longitudinal edge, at least one of said oblique edge, said leading edge and said longitudinal edge having a second contoured edge treatment.

13. The fixed-blade broadhead of claim 12 wherein said oblique edge has a second contoured edge treatment and said leading edge has a third contoured edge treatment.

14. A broadhead comprising:

a plurality of blades extending radially from a central longitudinal axis to a cutting edge, each of said plurality of blades having an interior edge and a trailing edge; and a linear tapered edge provided on at least one of said interior edge and said trailing edge.

15. The broadhead of claim 14 wherein each of said plurality of blades having a tapered cross-section from said central longitudinal axis to said cutting edge.

16. The broadhead of claim 14 wherein each of said plurality of blades having an aperture formed in an interior portion thereof.

17. The broadhead of claim 14 wherein each of said plurality of blades having a recess formed in an interior portion thereof.

18. A broadhead comprising:

a plurality of blades extending radially from a central longitudinal axis to a cutting edge, each of said plurality of blades having a recess defining a web formed in an interior portion thereof, an interior edge and a trailing edge; and a contoured edge treatment in cross-section provided on at least one of said interior edge and said trailing edge.

19. The broadhead of claim 18 wherein each of said plurality of blades having a tapered cross-section from said central longitudinal axis to said cutting edge.

20. The broadhead of claim 18 wherein said contoured edge comprises a non-linear tapered edge.

21. The broadhead of claim 18 wherein said contoured edge comprises a rounded edge.

22. A broadhead comprising:

a ferrule having a tip, a central portion and a shank portion;

a plurality of blades equiangularly disposed about said ferrule and extending radially from said central portion, each of said plurality of blades having an aperture formed therethrough to define a lateral portion, a medial portion and a radial portion with a leading edge, said leading edge having an asymmetric treatment to induce a rotational moment on said broadhead during flight.

23. The broadhead of claim 22 wherein said asymmetric treatment comprises a liner tapered edge.

24. The broadhead of claim 22 wherein said asymmetric treatment comprises a non-linear tapered edge.

25. The broadhead of claim 22 wherein said lateral portion comprises a sharpened cutting edge and an tapered oblique edge.

26. The broadhead of claim 25 wherein said tapered oblique edge comprises a linear tapered edge.

27. The broadhead of claim 26 wherein said tapered oblique edge comprises a non-linear tapered edge.

28. A broadhead comprising:

a plurality of generally planar blades extending radially from a central longitudinal axis to a cutting edge, each of said plurality of blades having an interior edge and a trailing edge; and an asymmetric edge treatment provided on at least one of said interior edge and said trailing edge for inducing a rotational moment of said broadhead during flight.

29. The broadhead of claim 28 wherein each of said plurality of blades having a tapered cross-section from said central longitudinal axis to said cutting edge.

30. The broadhead of claim 28 wherein each of said plurality of blades having an aperture formed in an interior portion thereof.

31. The broadhead of claim 28 wherein each of said plurality of blades having a recess formed in an interior portion thereof.

32. The broadhead of claim 28 wherein said contoured edge comprises a linear tapered edge.

33. The broadhead of claim 28 wherein said contoured edge comprises a non-linear tapered edge.

34. The broadhead of claim 28 wherein said contoured edge comprises a rounded edge.

35. The broadhead of claim 28 wherein said asymmetric edge treatment is formed on said interior edge.

* * * * *